US010793956B2

(12) United States Patent
Kubota et al.

(10) Patent No.: US 10,793,956 B2
(45) **Date of Patent: *Oct. 6, 2020**

(54) ADDITIVE FOR HIGH-PURITY COPPER ELECTROLYTIC REFINING AND METHOD OF PRODUCING HIGH-PURITY COPPER

(71) Applicant: MITSUBISHI MATERIALS CORPORATION, Tokyo (JP)

(72) Inventors: Kenji Kubota, Naka (JP); Yoshie Tarutani, Naka (JP); Kiyotaka Nakaya, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/248,038

(22) Filed: Aug. 26, 2016

(65) Prior Publication Data

US 2017/0058412 A1 Mar. 2, 2017

(30) Foreign Application Priority Data

Aug. 29, 2015 (JP) ..... 2015-169881
May 28, 2016 (JP) ..... 2016-106862

(51) Int. Cl.
*C25C 1/12* (2006.01)

(52) U.S. Cl.
CPC ..... *C25C 1/12* (2013.01)

(58) Field of Classification Search
None
See application file for complete search history.

(56) References Cited

U.S. PATENT DOCUMENTS 2,171,842 A * 9/1939 Barrett ..... C25D 3/02 205/306
2,769,775 A * 11/1956 Schloen ..... C25C 1/12 205/296
6,258,245 B1 * 7/2001 Cifuentes ..... C22B 3/0005 205/351
6,491,806 B1 * 12/2002 Dubin ..... C25D 3/38 205/123
10,407,785 B2 * 9/2019 Kubota ..... C08L 71/02
2002/0036144 A1 * 3/2002 Lee ..... C25D 3/38 205/296
2003/0070934 A1 * 4/2003 Cobley ..... C25D 3/02 205/263
2006/0065536 A1 * 3/2006 Jentz ..... C25D 3/38 205/291
2007/0037377 A1 * 2/2007 Richardson ..... H01L 24/11 438/613
2007/0170067 A1 * 7/2007 Kubota ..... C25D 3/56 205/244
2007/0284258 A1 * 12/2007 Yoshimoto ..... C25D 3/38 205/263
2008/0264799 A1 * 10/2008 Seelmann-Eggebert ..... C25B 1/00 205/351
2009/0145765 A1 * 6/2009 Abys ..... C25D 3/30 205/109
2009/0306231 A1 12/2009 Akella et al.
2013/0334057 A1 * 12/2013 Watanabe ..... C25C 1/12 205/296

FOREIGN PATENT DOCUMENTS

| | | | |
|---|---|---|---|
| CN | 1914358 | A | 2/2007 |
| CN | 101120119 | A | 2/2008 |
| CN | 103397349 | A | 11/2013 |
| CN | 103510105 | A | 1/2014 |
| JP | S49-014456 | B1 | 4/1974 |
| JP | 08-000990 | B2 | 1/1996 |
| JP | 2001-123289 | A | 5/2001 |
| JP | 2003-183875 | A | 7/2003 |
| JP | 2005-307343 | A | 11/2005 |
| JP | 2008-530367 | A | 8/2008 |
| JP | 2008-261050 | A | 10/2008 |
| JP | 2014-015677 | A | 1/2014 |
| JP | 2015-017318 | A | 1/2015 |
| WO | 2005/056884 | A1 | 6/2020 |

OTHER PUBLICATIONS

Saxena, S.K., Polyvinyl Alcohol (PVA) Chemical and Technical Assessment (CTA), 61st JECFA (Joint FAO/WHO Expert Committee on Food Additives, 2004 (no month), pp. 1-3 (Year: 2004).*
Non-Final Office Action from Applicant's copending U.S. Appl. No. 15/277,508, filed Dec. 19, 2018 (Year: 2018).*
Machine translation of JP 2005-307343, obtained from http://worldwide.espacenet.com (Year: 2005).*
"Lugalvan(R) BNO 12" Technical Information, BASF, May 2000, available at https://www.chempoint.com/products/download?grade=14385&type=tds (obtained on Jan. 6, 2020) (Year: 2000).*
Office Action dated Oct. 17, 2019, issued for the Chinese patent application No. 201610751052.1 and English translation thereof.
International Search Report dated Oct. 27, 2015, issued for PCT/JP2015/078050.

(Continued)

*Primary Examiner* — Harry D Wilkins, III
(74) *Attorney, Agent, or Firm* — Locke Lord LLP

(57) ABSTRACT

The present invention provides an additive for high-purity copper electrolytic refining and a method of producing high-purity copper using the additive. The additive of the present invention for high-purity copper electrolytic refining can be added to a copper electrolyte in electrolytic refining for producing high-purity copper. The additive includes a main agent formed of a non-ionic surfactant which has a hydrophobic group containing an aromatic ring and a hydrophilic group containing a polyoxyalkylene group, and a stress relaxation agent formed of a polyvinyl alcohol or a derivative thereof.

16 Claims, No Drawings

(56) References Cited

OTHER PUBLICATIONS

Office Action dated Jan. 17, 2018, issued for the Chinese patent application No. 201580048272.1 and English translation thereof.
Office Action dated Jul. 2, 2018, issued for U.S. Appl. No. 15/509,496.
Office Action dated Jan. 31, 2019, issued for U.S. Appl. No. 15/509,496.
Office Action dated Dec. 25, 2019, issued for Japanese Patent Application No. 2016-106862 and English translation thereof.
Notice of Allowance dated Jun. 9, 2020, issued for Japanese Patent Application No. 2016-106862 and English translation thereof.

* cited by examiner

ADDITIVE FOR HIGH-PURITY COPPER ELECTROLYTIC REFINING AND METHOD OF PRODUCING HIGH-PURITY COPPER

BACKGROUND OF THE INVENTION

Field of the Invention

The present invention relates to an additive for high-purity copper electrolytic refining which is used to produce high-purity copper in which the concentration of impurities such as sulfur and silver is greatly reduced, and a method of producing high-purity copper using the additive.

Priority is claimed on Japanese Patent Application No. 2015-169881, filed on Aug. 29, 2015, and Japanese Patent Application No. 2016-106862, filed on May 28, 2016, the contents of which are incorporated herein by reference.

Background Art

As described in Japanese Examined Patent Application, Second Publication No. H08-990, a method of performing electrolysis on two stages of performing electrolysis in a copper sulfate aqueous solution, then performing electrolysis again in a copper nitrate aqueous solution at a low current density of 100 $A/m^2$ or less by means of using copper deposited on a cathode as an anode, is known as a method of producing high-purity copper.

Further, as described in Japanese Unexamined Patent Application, First Publication No. 2001-123289, a method of producing electrolytic copper foil in which mechanical characteristics and adhesion to a cathode are improved by adding a polyoxyethylene-based surfactant such as polyethylene glycol (PEG) to a copper sulfate electrolyte that contains chloride ion, glue, and an active sulfur component is known. Further, as described in Japanese Unexamined Patent Application, First Publication No. 2005-307343, a method of producing high-purity electrolytic copper of which the surface is smooth and in which the content of impurities such as silver and sulfur is small by a combination of a smoothing agent such as polyvinyl alcohol (PVA) and a slime accelerator such as PEG, is known.

SUMMARY OF THE INVENTION

Technical Problem

In the producing method including two stages of performing electrolysis in a copper sulfate bath and electrolysis in a copper nitrate bath as that of Japanese Examined Patent Application, Second Publication No. H08-990, there is a problem in that considerable time and efforts are taken in the electrolysis. Further, there is another problem in that the use of nitric acid causes a high environmental burden and a complicated wastewater treatment.

When a conventional additive (PVA, PEG, or the like) is used, it is difficult to increase the current density. Further, when the electrolyte is stirred to increase the current density, slime is blown up and adheres to the cathode so that the purity of electrolytic copper is degraded. In addition, since the additive strongly suppresses dissolution of the anode, the overvoltage of the anode is increased and a large amount of slime is generated at the time of dissolution of the anode. Therefore, the yield of the cathode is decreased and the amount of slime adhering to the cathode is increased. Moreover, since the conventional additive suppresses the deposition reaction of the cathode, there is a problem in that the sulfur concentration of electrolytic copper is increased and the purity thereof is degraded when an electrolyte contains sulfate groups.

Further, since the conventional additive (PEG or the like) strongly acts on the cathode similar to the anode, there is a problem in that the cathode is warped by stress being generated in the cathode at the time of electrodeposition so that the cathode falls off a SUS substrate during electrolytic refining.

In addition, since a water-soluble polymer additive, such as PEG or PVA, has extremely high hydrophilicity and poor ultraviolet absorptivity, quantitative analysis using high-performance liquid chromatography (HPLC) is difficult to perform, and the dissolution rate is high, it is difficult to accurately control the concentration. Further, dendrites may be easily generated on the surface of electrolytic copper when PEG is used. When PVA is used in order to solve the problem of dendrites, the surface of electrolytic copper becomes smooth, but silver as an impurity is not sufficiently reduced. Moreover, the producing method using a surfactant such as PEG described in Japanese Unexamined Patent Application, First Publication No. 2001-123289 has a problem in that the content of sulfur or the like in the electrolytic copper is high and high-purity electrolytic copper is unlikely to be obtained.

In the production of high-purity copper, an object of the present invention is to provide an additive for high-purity copper electrolytic refining which solves the above-described problems of the conventional producing methods, is capable of suppressing the generation of slime during electrolytic refining, and is capable of producing high-purity copper in which the amounts of impurities such as silver or sulfur are greatly decreased; and a method of producing high-purity copper using such an additive.

Solution to Problem

The present invention is made such that high-purity copper in which the amounts of impurities such as silver and sulfur are greatly decreased by suppressing the generation of slime can be produced using an additive that includes a stress relaxation agent and a main agent which is formed of a surfactant containing a specific hydrophobic group and a specific hydrophilic group. In other words, the present invention provides the above-described additive and a producing method using the additive.

The present invention relates to an additive for high-purity copper electrolytic refining and a method of producing high-purity copper with the following configurations.

[1] An additive for high-purity copper electrolytic refining which is an additive to be added to a copper electrolyte in electrolytic refining for producing high-purity copper, the additive including: a main agent formed of a non-ionic surfactant which has a hydrophobic group containing an aromatic ring and a hydrophilic group containing a polyoxyalkylene group; and a stress relaxation agent formed of a polyvinyl alcohol or a derivative thereof.

[2] The additive for high-purity copper electrolytic refining according to [1], in which the hydrophilic group of the main agent includes at least one of a polyoxyethylene group and a polyoxypropylene group, and the hydrophobic group of the main agent includes a phenyl group or a naphthyl group.

[3] The additive for high-purity copper electrolytic refining according to [1] or [2], in which the added number of moles of the polyoxyalkylene group of the hydrophilic group of the main agent is 2 to 20.

[4] The additive for high-purity copper electrolytic refining according to any one of [1] to [3], in which the stress relaxation agent is a polyvinyl alcohol which has a saponification rate of 70 to 99% by mole and has an average polymerization degree of 200 to 2500 or a derivative thereof.

[5] The additive for high-purity copper electrolytic refining according to [4], in which the polyvinyl alcohol derivative is a carboxy-modified polyvinyl alcohol, an ethylene-modified polyvinyl alcohol, or a polyoxyethylene-modified polyvinyl alcohol.

[6] A method of producing high-purity copper, including: performing copper electrolysis using a copper electrolyte to which a main agent and a stress relaxation agent are added, the main agent being formed of a non-ionic surfactant which has a hydrophobic group containing an aromatic ring and a hydrophilic group containing a polyoxyalkylene group, and the stress relaxation agent being formed of a polyvinyl alcohol or a derivative thereof.

[7] The method of producing high-purity copper according to [6], in which the copper electrolysis is performed such that the concentration of the main agent is 2 to 500 mg/L and the concentration ratio (Y/X) of the stress relaxation agent (Y) to the main agent (X) is in a range of 0.01 to 1.0 in the copper electrolyte.

[8] The method of producing high-purity copper according to [6] or [7], in which the copper electrolyte is a copper sulfate solution, a copper nitrate solution, or a copper chloride solution.

[9] The method of producing high-purity copper according to any one of [6] to [8], in which the copper electrolyte has a copper concentration of 5 to 90 g/L and is one of a copper sulfate solution which has a sulfuric acid concentration of 10 to 300 g/L, a copper nitrate solution which has a nitric acid concentration of 0.1 to 100 g/L, and a copper chloride solution which has a hydrochloric acid concentration of 10 to 300 g/L.

[10] The method of producing high-purity copper according to any one of [6] to [9], in which high-purity copper is produced in which both of the sulfur concentration and the silver concentration are 1 ppm by mass or less and the glossiness on the surface of electrolytic copper is 1 or greater.

Advantageous Effects of Invention

In high-purity copper electrolytic refining, the silver concentration and the sulfur concentration of electrolytic copper to be produced can be greatly reduced by means of using the additive of the present invention. Further, since the surface of the electrolytic copper becomes smooth, anode slime or an electrolyte is unlikely to remain on the surface of the electrolytic copper and thus high-purity electrolytic copper with fewer impurities can be obtained. For example, in copper electrolysis using a copper sulfate solution as an electrolyte, electrolytic copper in which the sulfur concentration is significantly small can be obtained. For example, high-purity copper in which both of the sulfur concentration and the silver concentration are respectively 1 ppm by mass or less and glossiness of the surface of electrolytic copper is 1 or greater can be obtained. Preferably, high-purity electrolytic copper in which both of the sulfur concentration and the silver concentration are respectively 0.5 ppm by mass or less and glossiness of the surface of electrolytic copper is 2 or greater can be produced.

Since the additive of the present invention does not excessively adhere to the surface of a copper anode, the copper anode is moderately dissolved and the amount of anode slime is smaller than in the case where PEG or the like is used, and thus the yield of electrolytic copper can be improved. The yield of electrolytic copper means a ratio of weight of an actually obtained cathode with respect to weight of a used anode, and a high yield indicates a high productivity. The yield is higher when the amount of generated anode slime is smaller. According to the additive of the present invention, a generation rate of the anode slime can be 30% or lower. Further, since the amount of anode slime is smaller than in the case where PEG or the like is used, electrolysis can be carried out at a high speed while the electrolyte is stirred. Moreover, since polyoxyethylene monophenyl ether, polyoxyethylene naphthyl ether, or the like does not contain sulfur in a molecular skeleton, it is preferable that the additive of the present invention, which is formed of such a compound, be used from the viewpoint that electrolytic copper in which the sulfur concentration is extremely small can be obtained. Further, an additive in which the added number of moles of a polyoxyethylene group or the like is 2 to 20 is preferable because the additive has excellent stability due to a short molecular chain compared to glue and a bath is easily controlled.

Since stress in electrodeposits of electrolytic copper deposited on the cathode is relaxed due to the stress relaxation agent contained in the additive of the present invention and the electrolytic copper is not warped, it is possible to obtain electrolytic copper which is stably held by the cathode for a long period of time, is finely deposited, and has a smooth surface.

DETAILED DESCRIPTION OF THE INVENTION

Detailed Description

Hereinafter, embodiments of the present invention will be described in detail.

An additive of the present embodiment is an additive to be added to a copper electrolyte in electrolytic refining for producing high-purity copper and is an additive for high-purity copper electrolytic refining including: a main agent formed of a non-ionic surfactant which has a hydrophobic group containing an aromatic ring and a hydrophilic group containing a polyoxyalkylene group; and a stress relaxation agent formed of a polyvinyl alcohol or a derivative thereof. Further, a producing method of the present embodiment is a method of producing high-purity copper using the above-described additive.

The additive of the present embodiment includes a main agent formed of a non-ionic surfactant which has a hydrophobic group containing an aromatic ring and a hydrophilic group containing a polyoxyalkylene group. The aromatic ring of the hydrophobic group of the main agent is a phenyl group, a naphthyl group, or the like, and examples thereof include monophenyl, naphthyl, cumyl, alkylphenyl, styrenated phenyl monophenyl, naphthyl, cumyl, alkylphenyl, styrenated phenyl, distyrenated phenyl, tristyrenated phenyl, and tribenzyl phenyl. The polyoxyalkylene group of the hydrophilic group of the main agent is a polyoxyethylene group, a polyoxypropylene group, or the like and may include both of a polyoxyethylene group and a polyoxypropylene group.

Specific examples of the compound of the main agent included in the additive of the present embodiment include polyoxyethylene monophenyl ether, polyoxyethylene methyl phenyl ether, polyoxyethylene octyl phenyl ether, polyoxyethylene dodecyl phenyl ether, polyoxyethylene naphthyl ether, polyoxyethylene styrenated phenyl ether, polyoxyethylene distyrenated phenyl ether, polyoxyethylene tristyrenated phenyl ether, polyoxyethylene cumyl phenyl ether, polyoxypropylene monophenyl ether, polyoxypropylene methyl phenyl ether, polyoxypropylene octyl phenyl ether, polyoxypropylene dodecyl phenyl ether, polyoxypropylene naphthyl ether, polyoxypropylene styrenated phenyl ether, polyoxypropylene distyrenated phenyl ether, polyoxypropylene tristyrenated phenyl ether, and polyoxypropylene cumyl phenyl ether.

The additive of the present embodiment is used by being added to a copper electrolyte for copper electrolytic refining. In the copper electrolytic refining, since the main agent included in the additive of the present embodiment includes a hydrophobic group of an aromatic ring and a hydrophilic group of a polyoxyalkylene group, it is possible to suppress silver ions and sulfur ions in an electrolyte from being deposited on the cathode substrate and to greatly reduce the silver concentration and the sulfur concentration in electrolytic copper. In addition, when the additive of the present embodiment is used, the amount of anode slime is smaller than in the case where PEG or the like is used. Specifically, since the main agent of the additive of the present embodiment includes a hydrophobic group and a hydrophilic group of a polyoxyalkylene group and the additive does not excessively adhere to the surface of the cathode substrate, dissolution of the copper anode is not excessively suppressed. Accordingly, the copper anode is moderately dissolved and the amount of anode slime is smaller than in the case where PEG or the like is used, the amount of anode slime adhering to the surface of the electrolytic copper deposited on the cathode substrate is decreased and thus high-purity electrolytic copper can be obtained.

In addition, the electrodeposited copper deposited on the surface of the cathode substrate becomes fine due to the main agent included in the additive of the present embodiment and thus the smoothness of the surface of the electrolytic copper is improved. Consequently, sulfur or anode slime in a copper electrolyte is unlikely to adhere to the surface of the electrolytic copper and remains thereon and thus it is difficult for the electrolytic copper to take sulfur and anode slime in. Therefore, high-purity electrolytic copper with fewer impurities can be obtained.

A conventional surfactant used for a copper electrolyte, for example, PEG does not have the above-described effects because a hydrophobic group thereof does not have an aromatic ring. Since the conventional surfactant such as PEG strongly adheres to the surface of the copper anode, dissolution of the copper anode is excessively obstructed. Accordingly, there is a disadvantage in that a large amount of anode slime is generated and this anode slime is taken into the surface of the electrolytic copper on the cathode substrate so that the copper grade is degraded. Specifically, the sulfur concentration in the electrolytic copper electrolytically refined using a copper electrolyte to which PEG or the like is added is significantly greater than in the case where the additive of the present embodiment is used. The additive of the present embodiment is capable of significantly reducing the sulfur concentration in the electrolytic copper compared to the conventional surfactant such as PEG It is preferable that the aromatic ring of the hydrophobic group of the main agent be a monophenyl group or a naphthyl group. In addition, as the polyoxyalkylene group of the hydrophilic group of the main agent, a polyoxyethylene group, a polyoxypropylene group, or a combination of a polyoxyethylene group and a polyoxypropylene group may be exemplified. Among these, a polyoxyethylene group is particularly preferable. Preferred examples of the main agent included in the additive of the present embodiment include polyoxyalkylene monophenyl ether having an added number of moles of 2 to 20 and polyoxyalkylene naphthyl ether having an added number of moles of 2 to 20.

Specific preferred examples of the main agent are shown below. Formula [1] represents polyoxyethylene monophenyl ether and Formula [2] represents polyoxyethylene naphthyl ether. n of Formulae [1] and [2] represents the added number of moles of a polyoxyethylene group.

[1]

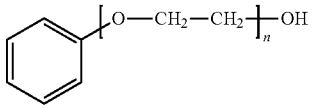

[2]

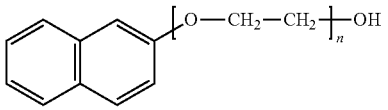

In the main agent, the added number of moles of the polyoxyalkylene group of the hydrophilic group is preferably 2 to 20 and more preferably 2 to 15. When the added number of moles is less than 2, the main agent is not dissolved in a copper electrolyte. When the added number of moles exceeds 20, since the additive adhering to the surface of the anode becomes excessively fine and the dissolution reaction of the anode is excessively suppressed, a large amount of anode slime is generated and the yield of electrolytic copper is decreased. Further, when the added number of moles exceeds 20, dendrites are easily generated on the surface of electrolytic copper deposited on the cathode substrate and the smoothness of the surface is degraded. Therefore, since the anode slime or sulfur in a copper electrolyte easily adheres to the surface of electrolytic copper and remains thereon, the purity of electrolytic copper is degraded. When the added number of moles of the polyoxyalkylene group of the main agent is 2 to 20, the dissolution of the anode appropriately progresses and thus the amount of anode slime is smaller than in the case where PEG or the like is used. Therefore, high-purity electrolytic copper can be obtained. Further, the additive including a polyoxyalkylene group having an added number of moles of 2 to 15 can greatly reduce the sulfur concentration in the electrolytic copper.

Since the bath temperature of a copper electrolyte affects the electrodeposition reaction, the preferable range of the added number of moles of the polyoxyethylene group varies depending on the bath temperature thereof. For example, the added number of moles is preferably 2 to 15 when the bath temperature thereof is in a range of 20° C. to 55° C. and the added number of moles is preferably 9 to 20 when the bath temperature thereof is in a range of 55° C. to 75° C.

A compound which does not include a phenyl group or a naphthyl group and which only includes a polyoxyethylene group or the like as a hydrophilic group has a poor effect in smoothing electrodeposition on the cathode substrate. For example, when polyoxyethylene glycol having an added number of moles of 8 is used, the surface, particularly the end portion of the electrolytic copper, becomes rough under the condition of a current density of 200 A/m$^2$, compared to a case where polyoxyethylene monophenyl ether in which the added number of moles of a polyoxyethylene group is 8 is used in the additive.

The stress relaxation agent included in the additive of the present embodiment is formed of a polyvinyl alcohol or a derivative thereof. The stress relaxation agent relaxes the stress in electrodeposits of electrolytic copper deposited on the cathode substrate to prevent the electrolytic copper from falling off the cathode substrate. Since the electrolytic copper is stably held by the cathode substrate for a long period of time by relaxing the stress in electrodeposits, electrolytic copper having a smooth surface on which copper is finely electrodeposited can be obtained. When the stress in electrodeposits is accumulated without being relaxed, the electrolytic copper is warped, peeled from and falls off the cathode substrate.

The polyvinyl alcohol or the derivative thereof of the stress relaxation agent is, for example, a carboxy-modified polyvinyl alcohol, an ethylene-modified polyvinyl alcohol, or a polyoxyethylene-modified polyvinyl alcohol.

It is preferable that the polyvinyl alcohol or the derivative thereof have a saponification rate of 70 to 99% by mole. When the saponification rate is less than 70% by mole, the effect of relaxing the stress in electrodeposits is degraded. In a case of complete saponification (saponification rate of 100% by mole), the solubility is significantly decreased and the polyvinyl alcohol or the derivative thereof may not be dissolved in a copper electrolyte. It is more preferable that the polyvinyl alcohol or the derivative thereof have a saponification rate of 70 to 90% by mole, but the saponification rate is not limited thereto. The saponification rate can be measured based on testing methods for polyvinyl alcohol defined in JIS K 6726:1994.

It is preferable that the polyvinyl alcohol or the derivative thereof of the stress relaxation agent have an average polymerization degree of 200 to 2500. The basic structure of the polyvinyl alcohol and the derivative thereof is formed of a completely saponified type with a hydroxyl group and a partially saponified type with an acetic acid group. The polymerization degree of the polyvinyl alcohol and the derivative thereof is the total value of those of completely saponified type and a partially saponified type, and the average polymerization degree is an average value of the polymerization degree. The average polymerization degree can be measured based on testing methods for polyvinyl alcohol defined in JIS K 6726:1994.

When an average polymerization degree of the polyvinyl alcohol or the derivative thereof is less than 200, the effect of relaxing the stress in electrodeposits is decreased. Further, since it is difficult to produce the polyvinyl alcohol or the derivative thereof having an average polymerization degree of less than 200 and these are not typically used, these are difficult to obtain. Moreover, when the average polymerization degree exceeds 2500, the effect of relaxing the stress in electrodeposits gradually disappears and electrolytic copper deposited on the cathode substrate is easily warped. Further, when the average polymerization degree exceeds 2500, an electrodeposition suppression effect occurs so that the yield of electrolytic copper tends to be decreased. It is more preferable that the average polymerization degree of the polyvinyl alcohol or the derivative thereof be set to be in a range of 200 to 2000, but the degree is not limited thereto.

The main agent and the stress relaxation agent may be mixed with each other in advance so as to have a predetermined concentration and added to a copper electrolyte as an additive or may be respectively added to a copper electrolyte so as to have a predetermined concentration.

The additive of the present embodiment is added to a copper electrolyte for use. In the copper electrolyte, the concentration of the main agent is preferably in a range of 2 to 500 mg/L and more preferably in a range of 10 to 300 mg/L. When the concentration of the main agent is less than 2 mg/L, the smoothness of the surface of the electrolytic copper is degraded since the effect of suppressing caused by the main agent is poor. In a case where the smoothness of the surface of the electrolytic copper is degraded, the copper electrolyte adheres to the surface of the electrolytic copper and is easily taken into the electrolytic copper, and therefore the sulfur concentration and the silver concentration in the electrolytic copper are increased. When the concentration of the main agent exceeds 500 mg/L, the amount of slime generated is increased due to strong adhesion of the slime to the surface of the anode. Further, the slime and an excessive amount of additive are taken into the electrolytic copper of the cathode substrate and thus the sulfur concentration and the silver concentration in the electrolytic copper are increased.

It is preferable that the concentration ratio (Y/X) of the concentration (mg/L) of the stress relaxation agent (Y) to the concentration of the main agent (X) be in a range of 0.01 to 1.0. When the concentration of the stress relaxation agent is higher than the concentration of the main agent and the Y/X ratio exceeds 1.0, the electrolytic copper is slightly warped. When the concentration of the stress relaxation agent is low and the Y/X ratio is less than 0.01, the effect of the stress relaxation agent is decreased. It is more preferable that the Y/X ratio be set to be in a range of 0.01 to 0.5, but the ratio thereof is not limited thereto. Here, in the additive of the present embodiment, it is preferable that the main agent and the stress relaxation agent are mixed with each other so that the concentration ratio thereof is in the above-mentioned range when the additive is added to the copper electrolyte.

The copper electrolyte using the additive of the present embodiment is a copper compound solution of mineral acid such as a copper sulfate solution, a copper nitrate solution, or a copper chloride solution. In a case where a copper sulfate solution is used as a copper electrolyte, the sulfuric acid concentration is preferably 10 to 300 g/L. When the sulfuric acid concentration is less than 10 g/L, copper hydroxide is generated on the surface of the electrolytic copper and the deposition state is degraded. When the sulfuric acid concentration exceeds 300 g/L, the amount of sulfuric acid to be taken into the electrolytic copper is increased and the sulfur concentration in the electrolytic copper is increased. The sulfuric acid concentration is more preferably 10 to 100 g/L, but the concentration thereof is not limited thereto. In a case where the copper electrolyte is a copper nitrate solution, the concentration of nitric acid is preferably 0.1 to 100 g/L and more preferably 0.1 to 50 g/L, but the concentration thereof is not limited thereto. In a case where the copper electrolyte is a copper chloride solution, the concentration of hydrochloric acid is preferably 10 to 300 g/L and more preferably 10 to 200 g/L, but the concentration thereof is not limited thereto.

Even when the copper electrolyte is any one of a copper sulfate solution, a copper nitrate solution, or a copper chloride solution, the copper concentration of the copper electrolyte is preferably 5 to 90 g/L (the copper sulfate pentahydrate concentration is preferably 20 to 350 g/L, the copper nitrate trihydrate concentration is preferably 19 to 342 g/L, and the copper chloride dihydrate concentration is preferably 13 to 241 g/L). When the copper concentration is less than 5 g/L, since the electrolytic copper is deposited in a powder state, the purity thereof is degraded. When the copper concentration exceeds 90 g/L, since the copper electrolyte is easily taken into the electrolytic copper, the purity thereof is degraded. Therefore, it is preferable that the copper concentration of the copper electrolyte be set to be in a range of 20 to 70 g/L, but the copper concentration thereof is not limited thereto.

In a case where the copper electrolyte is a copper sulfate solution or a copper nitrate solution, the chloride ion concentration of the copper electrolyte is preferably 200 mg/L or less. When the chloride ion concentration exceeds 200 mg/L, since a chloride is easily taken into the electrolytic copper, the purity of the electrolytic copper is degraded. Further, it is preferable that the lower limit of the chloride ion concentration be set to 5 mg/L and more preferable that the chloride ion concentration be set to be in a range of 5 to 150 mg/L, but the concentration thereof is not limited thereto.

Since the additive of the present embodiment includes a main agent formed of a non-ionic surfactant which has a hydrophilic group such as a polyoxyethylene group and a hydrophobic group such as a phenyl group or a naphthyl group and the main agent has strong ultraviolet absorptivity and hydrophobicity, quantitative analysis using high-performance liquid chromatography (HPLC) can be performed. Here, the copper electrolytic refining may be performed in a manner in which the concentration of the main agent in the copper electrolyte is measured by HPLC and a decreased amount of the main agent is replenished such that the concentration of the main agent is maintained to be preferably in a range of 2 to 500 mg/L and more preferably in a range of 10 to 300 mg/L. Further, the copper electrolytic refining may be performed in a manner in which a decreased amount of the main agent and the stress relaxation agent (or an additive) is replenished such that the concentration ratio (Y/X) of the stress relaxation agent to the main agent is maintained to be in range of 0.01 to 1.0.

EXAMPLES

Examples and comparative examples of the present invention will be described below. The sulfur concentration and the silver concentration in each of electrolytic coppers produced in the examples and the comparative examples described below were measured by glow discharge mass spectrometry (GDMS). Further, the sulfur concentration and the silver concentration of the central portion of each of the electrolytic coppers were measured. As the glossiness of the surface of each of the electrolytic coppers, the glossiness of the central portion thereof was measured under the condition of an angle (incident angle) of 60° using a glossmeter (HANDY GLOSSMETER PG-1M, manufactured by NIPPON DENSHOKU INDUSTRIES Co., LTD.) in accordance with JIS Z 8741:1997 (corresponding to ISO 2813:1994 and ISO 7668:1986). When the glossiness thereof was less than 1, since the copper electrolyte adhering to the surface of the electrolytic copper was difficult to be washed sufficiently with water, the copper electrolyte easily remained on the surface of the electrolytic copper and thus the purity of the electrolytic copper was degraded. The warpage of each of the electrolytic coppers was determined by visual observation. Electrolytic copper which was not warped was evaluated as "A", electrolytic copper which was slightly warped was evaluated as "B", and electrolytic copper which was greatly warped and apparently peeled from the cathode substrate was evaluated as "C". Specifically, electrolytic copper which did not peel from the cathode substrate was determined as not warped and evaluated as "A", electrolytic copper of which half or more of the area peeled from the cathode substrate was determined as greatly warped and evaluated as "C", and other electrolytic copper was determined as warped and was evaluated as "B". The slime generation rates in the examples and the comparative examples were calculated by the following equation. Moreover, the dissolution amount of the anode in the following equation is an amount of change in weight of the anode before and after electrolytic refining.

$$\text{Slime generation rate (\%)} = 100 - (\text{weight of deposited electrolytic copper})/(\text{dissolution amount of anode}) \times 100$$

Example 1

A copper sulfate solution, a copper nitrate solution, or a copper chloride solution was used as a copper electrolyte. The acid concentration of the copper electrolyte was set to 50 g/L and the copper concentration thereof was set to 50 g/L. The chloride ion concentration of the copper electrolyte other than the copper chloride bath (copper chloride solution) was set to 100 mg/L. 30 mg/L of main agents (A and B) were added to the copper electrolyte and stress relaxation agents (D to G) were added to the copper electrolyte such that the amount thereof made the ratio (Y/X) of the concentration (mg/L) of the stress relaxation agent to the main agent become the value listed in Table 1. The type of main agent, the added number of moles (n) of ethylene oxide, the concentration (mg/L), the type of stress relaxation agent, the saponification rate (% by mole), the average polymerization degree, and the concentration (mg/L) are listed in Table 1. Electrolytic copper having a sulfur concentration of 5 ppm by mass and a silver concentration of 8 ppm by mass was used as an anode and SUS 316 was used as a cathode substrate. The current density was set to 200 A/m$^2$ and electrolysis was performed at a bath temperature of 30° C. The concentration of the main agent and the concentration of the stress relaxation agent were measured by HPLC using an ODS column and GPC column every 12 hours and the decreased amount of the main agent and the stress relaxation agent was replenished such that the concentration of the main agent was maintained at 30 mg/L and the concentration of the stress relaxation agent was maintained at the concentration ratio (Y/X) of Table 1, thereby producing electrolytic coppers. The results thereof are listed in Table 1 (sample Nos. 1 to 14).

Comparative Example 1

Electrolytic coppers were produced by performing electrolytic refining using, as a copper electrolyte, the same copper sulfate solution as in Example 1 in the same manner as in Example 1 except that 30 mg/L of main agents (A to C, PEG) were added to the copper electrolyte, a stress relaxation agent was not added in a case of sample Nos. 15 to 17, and a stress relaxation agent D was added in a case of sample No. 18. The results thereof are listed in Table 1 (sample Nos. 15 to 18). Further, electrolytic coppers were produced by performing electrolytic refining using, as a copper electrolyte the same copper sulfate solution as in Example 1 in the same manner as in Example 1 except that both of the main agent and the stress relaxation agent were not added to the copper electrolyte (sample No. 19) or polyethylene glycol (PEG) was added (sample No. 20). The results thereof are listed in Table 1.

As listed in Table 1, in each of sample Nos. 1 to 14 of Example 1, the sulfur concentration in electrolytic copper was significantly low and the silver concentration in electrolytic copper was also low. Further, the slime generation rate was 29% or less and the glossiness of the surface of the electrolytic copper was 2 or greater.

In all comparative samples Nos. 15 to 17 of Comparative Example 1 in which a stress relaxation agent was not used, each of the electrolytic coppers was greatly warped and the glossiness of the surface of electrolytic copper was low. Further, in comparative sample No. 18 using a main agent C and a stress relaxation agent D, the sulfur concentration and the silver concentration in electrolytic copper were large, the slime generation rate was high, and the glossiness of the surface of electrolytic copper was significantly low. It was confirmed that the main agent did not have the effect of suppressing the generation of slime since the main agent C was different from the main agents A and 13 used in Example 1 and did not include a hydrophobic group of an aromatic ring. In addition, it was confirmed that the combination of the main agent C and the stress relaxation agent D was not preferable since the sulfur concentration and the silver concentration in electrolytic copper and the slime generation rate were significantly increased when the main agent C and the stress relaxation agent D were used in combination.

be obtained by combining the main agent and the stress relaxation agent formed of a polyvinyl alcohol or a derivative thereof.

In comparative sample No. 19 of Comparative Example 1 in which both of a main agent and a stress relaxation agent were not used, the amount of slime generated was low because the sample did not have the effect of suppressing dissolution of the anode resulting from an additive, but the sulfur concentration and the silver concentration in electrolytic copper were high and the surface of the electrolytic copper became significantly rough. Consequently, the glossiness was not able to be measured using the glossmeter. In sample No. 20 in which PEG as the conventional surfactant was used, the slime generation rate was high and the sulfur concentration and the silver concentration in electrolytic copper were higher than those of the sample Nos. 1 to 14 of Example 1. Further, since dendrites were easily generated on the surface of electrolytic copper, the glossiness was not able to be measured. In addition, in both sample Nos. 19 and 20 of Comparative Example 1, electrolytic coppers were warped.

TABLE 1

| | | Main agent (X) | | | Stress relaxation agent (Y) | | | | | Electrolytic copper | | | | |
|---|---|---|---|---|---|---|---|---|---|---|---|---|---|---|
| No | Copper electrolyte | Type | n | Concentration | Type | Saponification rate | Average polymerization degree | Concentration | Concentration ratio (Y/X) | S | Ag | Slime generation rate | Glossiness | Warpage |
| 1 | Copper sulfate | A | 2 | 30 | D | 88 | 200 | 30 | 1 | 0.4 | 0.3 | 23 | 3.4 | A |
| 2 | | | 5 | 30 | D | 99 | 150 | 0.24 | 0.008 | 0.1 | 0.4 | 19 | 2.0 | B |
| 3 | | | 15 | 30 | D | 88 | 2500 | 30 | 1 | 0.3 | 0.4 | 29 | 3.3 | A |
| 4 | Copper chloride | A | 5 | 30 | D | 88 | 3000 | 45 | 1.5 | 0.08 | 0.5 | 27 | 2.2 | B |
| 5 | Copper sulfate | A | 5 | 30 | D | 70 | 500 | 0.35 | 0.01 | 0.5 | 0.4 | 18 | 2.5 | A |
| 6 | | | 5 | 30 | E | 97 | 1800 | 30 | 1 | 0.3 | 0.3 | 21 | 2.6 | A |
| 7 | | | 5 | 30 | E | 78 | 620 | 15 | 0.5 | 0.5 | 0.1 | 18 | 2.4 | A |
| 8 | | | 12 | 30 | E | 86 | 250 | 3 | 0.1 | 0.6 | 0.3 | 15 | 3.0 | A |
| 9 | Copper nitrate | A | 10 | 30 | F | 96 | 1700 | 18 | 0.6 | 0.05 | 0.5 | 24 | 2.1 | A |
| 10 | | | 20 | 30 | F | 99 | 400 | 30 | 1 | 0.07 | 0.5 | 26 | 2.9 | A |
| 11 | Copper sulfate | B | 2 | 30 | D | 88 | 600 | 30 | 1 | 0.5 | 0.2 | 18 | 2.5 | A |
| 12 | | | 7 | 30 | G | 98 | 700 | 1.5 | 0.05 | 0.4 | 0.3 | 19 | 2.8 | A |
| 13 | | | 20 | 30 | E | 78 | 620 | 15 | 0.5 | 0.5 | 0.3 | 20 | 3.1 | A |
| 14 | Copper nitrate | B | 2 | 30 | F | 96 | 1700 | 30 | 1 | 0.1 | 0.5 | 25 | 2.3 | A |
| 15 | Copper sulfate | A | 15 | 30 | — | — | — | | — | 0.9 | 0.3 | 23 | 1.8 | C |
| 16 | Copper sulfate | B | 10 | 30 | — | — | — | | — | 0.8 | 0.4 | 25 | 1.1 | C |
| 17 | Copper sulfate | C | 12 | 30 | — | — | — | | — | 3.5 | 1.2 | 32 | 0.6 | C |
| 18 | Copper sulfate | C | 15 | 30 | D | 88 | 600 | 15 | 0.5 | 3.1 | 1.0 | 31 | 0.7 | C |
| 19 | Copper sulfate | — | — | — | — | — | — | — | — | 55 | 3.2 | 3 | Impossible to measure | C |
| 20 | Copper sulfate | PEG | 14 | 30 | — | — | — | — | — | 4.2 | 1.5 | 48 | Impossible to measure | C |

(Note)

The main agent A is polyoxyethylene phenyl ether, the main agent B is polyoxyethylene naphthyl ether, the main agent C is polyoxyethylene dodecyl ether, the stress relaxation agent D is a polyvinyl alcohol, the stress relaxation agent E is a carboxy-modified polyvinyl alcohol, the stress relaxation agent F is an ethylene-modified polyvinyl alcohol, the stress relaxation agent G is a polyoxyethylene-modified polyvinyl alcohol, PEG is polyethylene glycol, n represents the added number of moles of ethylene oxide, the unit of concentration of the main agent and the stress relaxation agent is mg/L, the unit of saponification rate is % by mole, the concentration ratio indicates the concentration ratio (Y/X) of the stress relaxation agent (Y) to the main agent (X), S represents the sulfur concentration, Ag represents the silver concentration, the units of S and Ag are both ppm by mass, and the unit of slime generation rate is %.

As shown in sample Nos. 1 to 14 of Example 1, it was confirmed that it was preferable that the main agent used in combination with a stress relaxation agent be formed of a non-ionic surfactant including a hydrophobic group which had an aromatic ring and a hydrophilic group which had a polyoxyalkylene group, and that electrolytic copper in which the sulfur concentration and the silver concentration therein were low and the slime generation rate was low and which had no warpage and had high glossiness was able to

Example 2

Electrolytic coppers were produced by electrolytic refining in the same manner as in Example 1 except that a copper sulfate solution (sulfur concentration of 100 g/L, copper concentration of 40 g/L) or a copper nitrate solution (nitric acid concentration of 10 g/L, copper concentration of 40 g/L) was used as a copper electrolyte, an additive formed of the main agent A (added number of moles of 5) and the stress relaxation agent D (saponification rate of 88% by mole, average polymerization degree of 200) of Example 1 were used, an additive formed of the main agent B (added number of moles of 7) and the stress relaxation agent E (saponification rate of 78% by mole, average polymerization degree of 620) of Example 1 were used, and these agents were added to the copper electrolyte such that the concentrations of the main agent and the stress relaxation agent become the values listed in Table 2. The results thereof are listed in Table 2. As listed in Table 2, it was confirmed that the concentration of the main agent was preferably in a range of 2 to 500 mg/L in all cases.

TABLE 2

| No | Copper electrolyte | Main agent Type | Main agent Concentration | Stress relaxation agent Type | Stress relaxation agent Concentration | Slime generation rate (%) | Electrolytic copper S | Electrolytic copper Ag | Electrolytic copper Warpage |
|---|---|---|---|---|---|---|---|---|---|
| 21 | Copper | A | 1 | D | 0.1 | 5 | 1.8 | 1.2 | B |
| 22 | sulfate | | 2 | | 0.2 | 5 | 0.9 | 0.8 | A |
| 23 | | | 100 | | 10 | 11 | 0.2 | 0.3 | A |
| 24 | | | 500 | | 50 | 19 | 0.7 | 0.6 | A |
| 25 | | | 600 | | 60 | 26 | 1.1 | 1.0 | B |
| 26 | Copper | B | 1 | E | 0.1 | 4 | 0.9 | 1.3 | B |
| 27 | nitrate | | 2 | | 0.2 | 5 | 0.8 | 0.9 | A |
| 28 | | | 100 | | 10 | 12 | 0.2 | 0.1 | A |
| 29 | | | 500 | | 50 | 18 | 0.4 | 0.7 | A |
| 30 | | | 600 | | 60 | 24 | 0.4 | 1.2 | B |

(Note)

The main agent A is polyoxyethylene monophenyl ether (added number of moles of ethylene oxide is 5), the main agent B is polyoxyethylene naphthyl ether (added number of moles of ethylene oxide is 7), the stress relaxation agent D is a polyvinyl alcohol (saponification rate of 88% by mole, average polymerization degree of 200), the stress relaxation agent E is a carboxy-modified polyvinyl alcohol (saponification rate of 78% by mole, average polymerization degree of 620), the slime generation rate is acquired using [100 − (cathode electrodeposition amount)/(anode dissolution amount) × 100], S represents the sulfur concentration, Ag represents the silver concentration, the units of S and Ag are both ppm by mass, the units of the concentration of the main agent and the concentration of the stress relaxation agent are mg/L, Nos. 21 to 30 represent samples of the example, and the sample Nos. 22 to 24 and Nos. 27 to 29 are within the preferable ranges.

Example 3

A copper sulfate solution or a copper nitrate solution was used as a copper electrolyte and the acid concentration and the copper concentration were adjusted so as to be the values listed in Table 2. Electrolytic coppers were produced by electrolytic refining in the same manner as in Example 1 except that the additive of the present invention formed of the main agent A (added number of moles of 15) and the stress relaxation agent D (saponification rate of 88% by mole, average polymerization degree of 200) used in Example 1 was added or the additive of the present invention formed of the main agent B (added number of moles of 7) and the stress relaxation agent G (saponification rate of 98% by mole, average polymerization degree of 700) was added. The results thereof are listed in Table 3. As listed in Table 3, it was confirmed that the sulfur concentration was preferably in a range of 10 to 300 g/L and the copper concentration was preferably in a range of 5 to 90 g/L in the copper sulfate solution used as a copper electrolyte, and that the nitric acid concentration was preferably in a range of 0.1 to 100 g/L and the copper concentration was preferably in a range of 5 to 90 g/L in the copper nitrate solution used as a copper electrolyte.

TABLE 3

| No | Composition of copper electrolyte (g/L) Type | Acid concentration | Copper concentration | Type and concentration of additive | Slime generation rate (%) | Electrolytic copper S | Electrolytic copper Ag | Electrolytic copper Warpage |
|---|---|---|---|---|---|---|---|---|
| 44 | Copper | 400 | 2 | A(30 mg/L) + D(30 mg/L) | 28 | 1.8 | 2.1 | B |
| 45 | sulfate | 300 | 5 | | 23 | 0.9 | 0.9 | A |
| 46 | | 10 | 90 | | 18 | 0.08 | 0.1 | A |
| 47 | | 1 | 100 | | 39 | 0.5 | 0.5 | B |
| 48 | Copper | 120 | 2 | B(30 mg/L) + G(1.5 mg/L) | 25 | 0.7 | 3.0 | B |
| 49 | nitrate | 100 | 5 | | 20 | 0.4 | 0.9 | A |
| 50 | | 0.1 | 90 | | 25 | 0.1 | 0.5 | A |
| 51 | | 0 | 100 | | 29 | 0.4 | 2.8 | B |

(Note)

The main agent A is polyoxyethylene monophenyl ether (added number of moles of ethylene oxide is 15), the stress relaxation agent D is a polyvinyl alcohol (saponification rate of 88% by mole, average polymerization degree of 200), the main agent B is polyoxyethylene naphthyl ether (added number of moles of ethylene oxide is 7), the stress relaxation agent G is a polyoxyethylene-modified polyvinyl alcohol (saponification rate of 98% by mole, average polymerization degree of 700), the slime generation rate is acquired using [100 − (cathode electrodeposition amount)/(anode dissolution amount) × 100], S represents the sulfur concentration, Ag represents the silver concentration, and the units of S and Ag are both ppm by mass.

While preferred embodiments of the invention have been described above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

INDUSTRIAL APPLICABILITY

According to the additive for high-purity copper electrolytic refining of the present invention and the producing method using this additive, generation of slime can be suppressed in electrolytic refining for high-purity copper and high-purity copper in which the sulfur concentration and the silver concentration are greatly decreased can be produced.

What is claimed is:

1. An additive for high-purity copper electrolytic refining which is an additive to be added to a copper electrolyte in electrolytic refining for producing high-purity copper, the additive consisting essentially of:

a main agent formed of a non-ionic surfactant which has a hydrophobic group containing an aromatic ring and a hydrophilic group containing a polyoxyalkylene group; and a stress relaxation agent formed of a polyvinyl alcohol or a derivative thereof, wherein the main agent is one or more selected from the group consisting of compounds represented by Formulae [1] and [2],

[1]

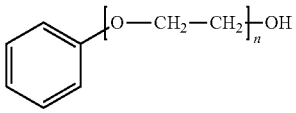

[2]

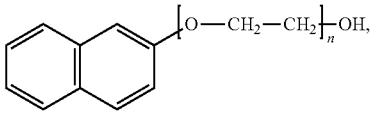

where n of Formulae [1] and [2] is an added number of moles of a polyoxyethylene group, and n is 2 to 20.

2. The additive for high-purity copper electrolytic refining according to claim 1, wherein the stress relaxation agent is a polyvinyl alcohol which has a saponification rate of 70 to 99% by mole and has an average polymerization degree of 200 to 2500 or a derivative thereof.

3. The additive for high-purity copper electrolytic refining according to claim 2, wherein the polyvinyl alcohol derivative is a carboxy-modified polyvinyl alcohol, an ethylene-modified polyvinyl alcohol, or a polyoxyethylene-modified polyvinyl alcohol.

4. The additive for high-purity copper electrolytic refining according to claim 1; wherein the main agent is one or more selected from the group consisting of compounds represented by Formulae [1]:

[1]

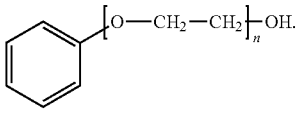

5. The additive for high-purity copper electrolytic refining according to claim 1; wherein the main agent is one or more selected from the group consisting of compounds represented by Formulae [2]:

[2]

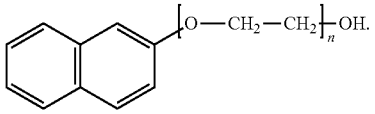

6. A method of producing high-purity copper, comprising:

performing copper electrolysis using a copper electrolyte to which a main agent and a stress relaxation agent are added, the main agent being formed of a non-ionic surfactant which has a hydrophobic group containing an aromatic ring and a hydrophilic group containing a polyoxyalkylene group, and the stress relaxation agent being formed of a polyvinyl alcohol or a derivative thereof, wherein the main agent is one or more selected from the group consisting of compounds represented by Formulae [1] and [2],

[1]

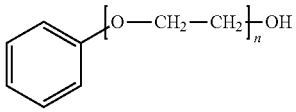

[2]

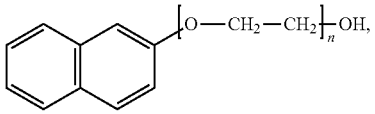

where n of Formulae [1] and [2] is an added number of moles of a polyoxyethylene group, and n is 2 to 20.

7. The method of producing high-purity copper according to claim 6, wherein the copper electrolysis is performed such that the concentration of the main agent is 2 to 500 mg/L and the concentration ratio (Y/X) of the stress relaxation agent (Y) to the main agent (X) is in a range of 0.01 to 1.0 in the copper electrolyte.

8. The method of producing high-purity copper according to claim 7, wherein the copper electrolyte is a copper sulfate solution, a copper nitrate solution, or a copper chloride solution.

9. The method of producing high-purity copper according to claim 7, wherein the copper electrolyte has a copper concentration of 5 to 90 g/L and is one of a copper sulfate solution which has a sulfuric acid concentration of 10 to 300 g/L, a copper nitrate solution which has a nitric acid concentration of 0.1 to 100 g/L, and a copper chloride solution which has a hydrochloric acid concentration of 10 to 300 g/L.

10. The method of producing high-purity copper according to claim 7, wherein high-purity copper is produced in which both of the sulfur concentration and the silver concentration are 1 ppm by mass or less and the glossiness on the surface of electrolytic copper is 1 or greater.

11. The method of producing high-purity copper according to claim 6, wherein the copper electrolyte is a copper sulfate solution, a copper nitrate solution, or a copper chloride solution.

12. The method of producing high-purity copper according to claim 11, wherein the copper electrolyte has a copper concentration of 5 to 90 g/L and is one of a copper sulfate solution which has a sulfuric acid concentration of 10 to 300 g/L, a copper nitrate solution which has a nitric acid concentration of 0.1 to 100 g/L, and a copper chloride solution which has a hydrochloric acid concentration of 10 to 300 g/L.

13. The method of producing high-purity copper according to claim 11, wherein high-purity copper is produced in which both of the sulfur concentration and the silver concentration are 1 ppm by mass or less and the glossiness on the surface of electrolytic copper is 1 or greater.

14. The method of producing high-purity copper according to claim 6, wherein the copper electrolyte has a copper concentration of 5 to 90 g/L and is one of a copper sulfate solution which has a sulfuric acid concentration of 10 to 300 g/L, a copper nitrate solution which has a nitric acid concentration of 0.1 to 100 g/L, and a copper chloride solution which has a hydrochloric acid concentration of 10 to 300 g/L.

15. The method of producing high-purity copper according to claim 14, wherein high-purity copper is produced in which both of the sulfur concentration and the silver concentration are 1 ppm by mass or less and the glossiness on the surface of electrolytic copper is 1 or greater.

16. The method of producing high-purity copper according to claim 6, wherein high-purity copper is produced in which both of the sulfur concentration and the silver concentration are 1 ppm by mass or less and the glossiness on the surface of electrolytic copper is 1 or greater.

* * * * *